US005610132A

United States Patent [19]

Momoda et al.

[11] Patent Number: 5,610,132

[45] Date of Patent: Mar. 11, 1997

[54] CLEANING AGENT FOR REMOVING FATS AND OILS FROM METAL SURFACES

[75] Inventors: Kayo Momoda, Tsukuba; Syuji Baba, Tokuyama, both of Japan

[73] Assignee: Tokuyama Corporation, Yamaguchi-ken, Japan

[21] Appl. No.: 493,460

[22] Filed: Jun. 22, 1995

[30] Foreign Application Priority Data

Jun. 24, 1994 [JP] Japan ..... 6-142812

[51] Int. Cl.[6] ..... C11D 7/50; C11D 7/26

[52] U.S. Cl. ..... 510/506; 510/245; 510/365; 134/40

[58] Field of Search ..... 252/162, 170, 252/173, 174.21, 174.22, DIG. 8, DIG. 10; 510/506, 245, 365; 134/40

[56] References Cited

U.S. PATENT DOCUMENTS

| | | | |
|---|---|---|---|
| 3,882,038 | 5/1975 | Clayton et al. | 252/164 |
| 4,592,787 | 6/1986 | Johnson | 134/38 |
| 4,808,235 | 2/1989 | Woodson et al. | 134/22.19 |
| 5,288,335 | 2/1994 | Stevens | 134/38 |
| 5,486,314 | 1/1996 | Wauk et al. | 252/542 |

FOREIGN PATENT DOCUMENTS

| | | |
|---|---|---|
| 2128846 | 1/1995 | Canada . |
| 0261874A2 | 3/1988 | European Pat. Off. . |
| 0347110A1 | 12/1989 | European Pat. Off. . |
| 636710 | 6/1994 | European Pat. Off. . |
| 5-9498 | 1/1993 | Japan . |
| 5-51599 | 3/1993 | Japan . |
| 6146041 | 5/1994 | Japan . |
| 6122897 | 5/1994 | Japan . |
| 133496 | 5/1995 | Japan . |
| 2247243 | 2/1992 | United Kingdom . |
| 94/06265A1 | 3/1994 | WIPO . |
| 94/05766A1 | 3/1994 | WIPO . |

*Primary Examiner*—Paul Lieberman
*Assistant Examiner*—Michael P. Tierney
*Attorney, Agent, or Firm*—Wenderoth, Lind & Ponack

[57] ABSTRACT

A cleaning agent comprising a mixture of a propylene glycol alkyl ether compatible with water any ratio, a propylene glycol alkyl ether compatible with water only at ratios of 50% by volume or less, and water, for example, the mixture having such a composition that each of 15% by volume or more of dipropylene glycol monomethyl ether, 10% by volume or more of dipropylene glycol monopropyl ether, and 15% by volume or more of water is uniformly dissolved in the other two components. This cleaning agent has high detergency on oily matter, has a characteristic that it is easy to separate the oily matter because the oily matter is not dissolved in the cleaning agent, and is low toxic.

7 Claims, 1 Drawing Sheet

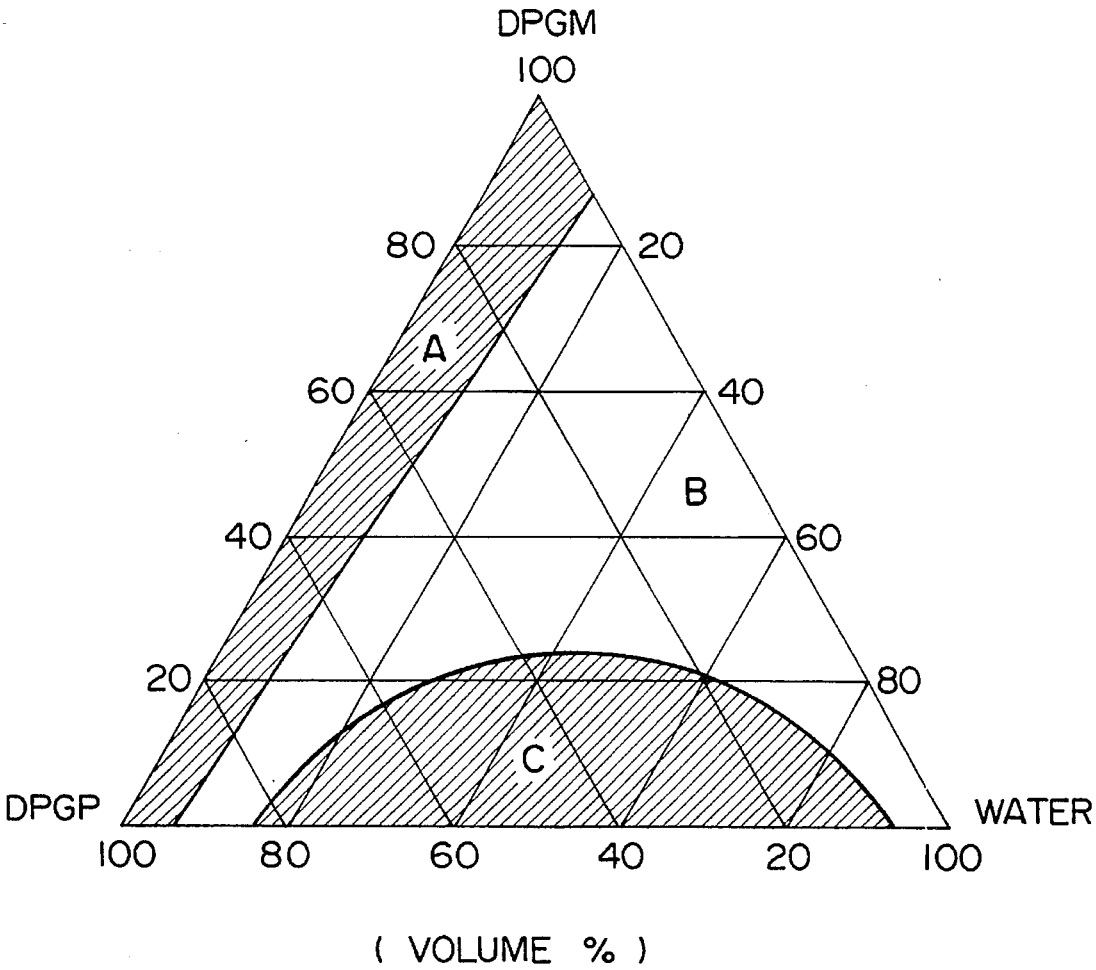
DPGM
100
80
20
A
60
40
B
40
60
20
80
C
DPGP
WATER
100
80
60
40
20
100
( VOLUME % )

CLEANING AGENT FOR REMOVING FATS AND OILS FROM METAL SURFACES

BACKGROUND OF THE INVENTION

1. Field of the Invention

This invention relates to a cleaning agent for removing foulings such as fats and oils adhering to metal parts, etc. and fluxes and fingerprints adhering to electronic parts, etc., and a cleaning method.

2. Description of the Prior Art

Freon solvents or halogenous solvents have been used for degreasing and cleaning matter to be cleaned such as metal parts, electronic parts, semiconductor parts, etc., chiefly because they are noncombustible and free of danger of ignition, and excellent in detergency. However, in recent years, under concern over the problem of destruction of the earth environment and influence on human bodies, conversion to aqueous cleaning agents containing surface active agents or alkalis as main components, hydrocarbonic cleaning agents, alcoholic cleaning agents, or quasi-aqueous cleaning agents wherein the third petroleum hydrocarbons are dispersed in water using surface active agents is being made.

However, in the case of cleaning methods using aqueous cleaning agents, there are problems that the cleaning agents have too high foamability, are insufficient in detergency, and corrode matter to be cleaned, and a large amount of waste water must be treated, and so on. Both hydrocarbonic cleaning agents and alcoholic cleaning agents are combustible, have high inflammability, and have the danger of ignition. Further, the quasi-aqueous cleaning agents have drawbacks that when phase separation takes place they have inflammability, nonuniformity arises in detergency, and a large amount of waste water must be treated, and so on.

A cleaning agent containing an alkylene glycol monophenyl ether, a glycol ether solvent and a surface active agent as main components is proposed in Japanese Laid-Open Patent Publication No. 51599/1993. However, this cleaning agent does not have sufficient detergency, and there is the possibility that since it contains nonvolatile components, they remain in the matter to be cleaned and have an influence thereon. Further, the growth and reproduction of organisms are influenced by ethylene glycol alkyl ether compounds, and their permissible concentrations are being strictly restricted, and the use thereof is not desirable.

Japanese Laid-Open Patent Publication No. 9498/1993 discloses a cleaning method comprising using composition which comprises a compound represented by the following formula $$R—O—A_n—COCH_3 \text{ or}$$

$$R—O—A_n—R$$

wherein R is a hydrogen atom or a lower alkyl group, A is an ethoxy or propoxy group, and n is 1 or 2, and water. However, specifically, a cleaning method is disclosed wherein as specific compounds to be used, compounds which dissolve in water at certain temperatures or more, but do not dissolve in water at temperatures lower than the certain temperatures, such as acetates, from propylene glycol monomethyl ether acetate down, and ethylene glycol diethyl ether are used, and their solubility dependent on temperature is utilized.

Therefore, there still exists a need for the provision of a cleaning agent which is rich in detergency on oily matter adhering to matter to be cleaned, easy to handle because there is no need of using it under specified temperatures, and further, safer from an ecological viewpoint.

SUMMARY OF THE INVENTION

The present inventors have vigorously studied on detergency of various propylene glycol alkyl ethers, under consideration of using propylene glycol alkyl ethers having less toxicity and higher safety than ethylene glycol alkyl ethers. As a result, they found that certain water sparingly soluble propylene glycol alkyl ethers have high detergency but also have inflammability, and on the other hand, certain water easily soluble propylene glycol alkyl ethers do not have inflammability when mixed with water, but there is a problem in their detergency.

As a result of the above finding, the present inventors have developed a cleaning agent excellent in detergency by mixing the above propylene glycol alkyl ether which has excellent detergency but is water sparingly soluble, the propylene glycol alkyl ether which does not exhibit enough detergency when used alone, but is water easily soluble, and water in an amount enough to lose inflammability. Thus, there is provided according to this invention a cleaning agent which comprises (A) at least one water easily soluble propylene glycol alkyl ether represented by the formula (I)

$$R^1O\left(CH(CH_3)CH_2O\right)_m\left(CH_2CH(CH_3)O\right)_nR^2 \quad (I)$$

wherein $R^1$ and $R^2$ are, independently, hydrogen atoms, methyl groups or ethyl groups, m and n are, independently, 0 or an integer of 1 to 3, and m+n is 1 to 3, provided that one of $R^1$ and $R^2$ is a group other than a hydrogen atom, and when both $R^1$ and $R^2$ are groups other than hydrogen atoms, both these substituents are methyl groups, and m is 1 and n is 0, (B) at least one water sparingly soluble propylene glycol alkyl ether represented by the formula (II)

$$R^3O\left(CH(CH_3)CH_2O\right)_p\left(CH_2CH(CH_3)O\right)_qR^4 \quad (II)$$

wherein $R^3$ and $R^4$ are, independently, hydrogen atoms, $C_{1-4}$ alkyl groups, p and q are, independently, 0 or an integer of 1 to 3, and p+q is 1 to 3, provided that one of $R^3$ and $R^4$ is a group other than a hydrogen atom, and when one of $R^3$ and $R^4$ is a hydrogen atom, the other substituent is an alkyl group of $C_3$ or more, when $R^3$ and $R^4$ are, independently, methyl or ethyl groups, p+q is an integer of 2 or more, and (C) water, and forms a single phase wherein each component is dissolved in the other components.

Further, a method for cleaning matter to be cleaned, for example, metal pieces, electronic parts or semiconductor parts or the like, on which fats and oils adhered, which method comprises using the above cleaning agent.

BRIEF DESCRIPTION OF THE DRAWINGS

FIG. 1 is the phase diagram of dipropylene glycol monomethyl ether-dipropylene glycol monopropyl ether-water. In the diagram, A is a region where each of the three components uniformly dissolves in the other components, but the solution has its flash point, B is a region where each of the three components uniformly dissolves in the other components, and the solution has no flash point, and C is a region where each of the three components does not uniformly dissolve in the other components.

DETAILED DESCRIPTION OF THE INVENTION

As stated above, the cleaning agent provided by this invention a mixed solution of a water easily soluble propylene glycol alkyl ether classified in (A), a water sparingly soluble propylene glycol alkyl ether classified in (B), and water of (C). This cleaning agent can contain other solvents in common use, so long as its detergency is badly influenced by them.

The term "water easily soluble" herein is used as a concept of using it as a measure that one of the component and water can freely dissolve in the other, at 60° C., in any mutual ratios, and to the contrary, the term "water sparingly soluble" is used as a concept of using it as a measure that one of the component and water can dissolve in the other, at 60° C., only in ratios of the component to water of 50% by volume or less, but these terms are not strictly restricted by the above-mentioned solubilities. Therefore, all of the compounds represented by the above formula (1) can be mentioned as components included in the former, and all of the compounds represented by the above formula (IT) can be mentioned as components included in the latter.

The compound of the formula (I) constituting the component (A) is monomethyl, monoethyl or dimethyl ether of propylene glycol (or 1,2-propanediol), dipropylene glycol (or bis(2-hydroxypropyl)ether) or tripropylene glycol, as understood from the definition. The propylene glycol alkyl ether as the component (A) has an action of enhancing compatibility between the later-described component (B) and water of (C), although it is not limited by the action mechanism. Such propylene glycol alkyl ethers include propylene glycol monomethyl ether, dipropylene glycol monomethyl ether, tripropylene glycol monomethyl ether, propylene glycol monoethyl ether, dipropylene glycol monoethyl ether, propylene glycol dimethyl ether, etc. and mixtures of two or more of them.

The compound of the formula (II) constituting the component (B) is water sparingly soluble, compared with the compounds of the formula (I). Thus, the compound classified herein, when it is a monoalkylether of the above propylene glycol, dipropylene glycol or tripropylene glycol, needs to be an ether having as its alkyl group ($R^3$ or $R^4$) a group selected from the group consisting of alkyl groups of $C_3$ or more, for example, n-propyl, isopropyl, n-butyl, isobutyl, sec-butyl and tert.-butyl groups. Further, when $R^3$and $R^4$ in the formula (II) are independently methyl or ethyl groups, the compound classified herein needs to be a dialkyl ether of dipropylene glycol or tripropylene glycol, wherein p+q are 2 or more. Propyl and butyl, herein, mean n-alkyl groups, unless otherwise particularly defined.

The propylene glycol alkyl ether as the component (B) is chiefly a component exhibiting detergency, although it is not limited by the action mechanism. Such propylene glycol alkyl ethers include propylene glycol monopropyl ether, dipropylene glycol monopropyl ether, tripropylene glycol monopropyl ether, dipropylene glycol dimethyl ether, tripropylene glycol dimethyl ether, dipropylene glycoldiethyl ether, dipropylene glycol dipropyl ether, etc., and mixtures of 2 or more of them.

When among these components (A) and components (B), those preferably used in this invention in view of detergency on oily matter and drying characteristics are exemplified, there can be mentioned, as the components (A), dipropylene glycol monomethyl ether, propylene glycol monoethyl ether and propylene glycol dimethyl ether, and there can be mentioned, as the components (B), preferably propylene glycol monopropyl ether, dipropylene glycol monopropyl ether and dipropylene glycol dimethyl ether, particularly dipreferably propylene glycol monopropyl ether.

Water as the component (C) seems to be combined with the above components (A) and (B) and act so as to reduce the inflammability of the components (A) and (B).

The combination of propylene glycol monopropyl ether or dipropylene glycol monopropyl ether, particularly the latter as the component (B) with the component (A) and the component (C), i.e., water is preferred from the viewpoint that drying is easy to carry out, while detergency on oily matter is not decreased, and the mixture scarcely exhibits inflammability. In cleaning agents of such combination, a possibility that there arises a problem on inflammability is extremely low, even if the content of water at comparatively low levels is adopted.

The mixing ratio among the component (A), the component (B) and the component (C) is not limited so long as these components can form a single phase wherein each component is dissolved in the other components, because in the case, the objects of this invention can be attained. However, since differences in compatibility are seen depending on the kind of each component, it is preferred that the cleaning agent of this invention comprises 15% by volume or more of the propylene glycol alkyl ether of (A), 10% by volume or more of (B) and 15% by volume or more of (C), respectively based on the whole volume of (A), (B) and (C), in view of giving stability in use and excellent detergency. Since the cleaning agent of this invention contains at least the above components (A), (B) and (C) as indispensable components, the respective upper limits thereof to be contained are under 75% by volume as to the component (A), under 70% by volume as to the component (B), and under 75% by volume as to the component (C).

Although it is preferred that the concentration of the component (B) is as high as possible in order to obtain higher detergency, too high concentrations thereof tend to cause phase separation, and therefore, it is further preferred to make the concentration of the component (B) under 50% by volume, make that of the component (A) 25% by volume or more, and make that of the component (C) 20% by volume or more.

In FIG. 1 is shown the phase diagram of the three components system composed of dipropylene glycol monomethyl ether as the component (A), dipropylene glycol monopropyl ether as the component (B) and water as the component (C). The region C in FIG. 1 is a region where each of the three components does not uniformly dissolve in the other components, and two phases of an oil phase and an aqueous phase are formed. The region A and the region B are regions where each of the three components dissolves in the other components, and a single phase is formed. Further, the regions where hatching was made are regions where the cleaning agents exhibit high inflammability. Although cleaning agents of any compositions in the above region A and region B are usable in this invention, cleaning agents fallin within the region A have inflammability because they have such compositions that the amount of water is as small as under 20% by volume. Therefore, cleaning agents having the compositions of the region B not exhibiting inflammability can be preferably used in this invention. When other components (or compounds) are used as the components (A) and (B), a person skilled in the art will be able to determine the optimum ratio on the combination of the components (A), (B) and (C), by preparing such a phase diagram.

The cleaning agent of this invention can be used, in place of known cleaning agents, in various cleaning steps known per se. Therefore, according to this invention, there is provided a method for cleaning matter to be cleaned, for example, metal pieces, electronic parts and semiconductor parts, to which fats and oils adhere, which method comprises using the above cleaning agent.

This cleaning method can be carried out by contacting matter to be cleaned with the cleaning agent of this invention. As this contact method, there can, representatively, be mentioned a method of immersing the matter to be cleaned in the cleaning agent or a method of showering or spraying the cleaning agent on the matter to be cleaned. It is effective, at this time, to combine a means such as ultrasonic cleaning, vibration or stirring.

Usually, the greater part of the oil removed from the matter to be cleaned does not dissolve in the cleaning agent, and separates as a floating oil or a precipitated oil from the cleaning agent. Therefore, the oil can readily be separated from the cleaning agent by treating the washings by an oil-water separation apparatus or the like. Further, the recovered cleaning agent is not polluted with the oil, and maintains high detergency for a long period. In the cases of usual cleaning agents displaying high detergency by dissolving oil, such as hydrocarbonic solvents, halogenous solvents and propylene glycol alkyl ethers, their detergency on matter to be cleaned is influenced by the concentrations of oils dissolving in the cleaning agents, and therefore, there is a need to separate the cleaning agents and the oils by distillation. However, there is no need therefor about the cleaning agent of this invention, and its high detergency can be maintained.

The cleaning agent of this invention can, of course, be applied to washing vessels for degreasing, and can also be applied to rinsing vessels for rinse following the washing vessels. Further, if matter to be cleaned is dried with adhesion of the cleaning agent of this invention, the agent is readily dried without any bad influence on the matter cleaned. Further, when water is used for the rinse of the matter to be cleaned after cleaning, it is unnecessary to use a large amount of rinsing water, which is different from the oases of aqueous cleaning agents or quasi-aqueous cleaning agents.

Thus, the cleaning agent of this invention is rich in detergency on oily matter on matter to be cleaned; is one such that it is easy to separate the oily matter therefrom because the oily matter washed off from the matter to be cleaned does not dissolve in the cleaning agent; and has a long liquid life. Further, since it is possible to make the cleaning agent non-inflammable by appropriately selecting the compounding amount of water, it can be used safely without explosion-proof equipment, which is needed in cleaning apparatuses using hydrocarbonic cleaning agents or alcoholic cleaning agents.

This invention is specifically described below by examples, but not limited thereto.

EXAMPLES 1 TO 14 AND COMPARATIVE EXAMPLES 1 TO 4

Test pieces were prepared by making a commercial machine oil adhere on aluminum sheets of 50 mm×80 mm×1 mm in an amount of about 50 mg/sheet, and 1L portions of cleaning agents of a uniform phase having the compositions shown in Table 1 were used, for cleaning. Cleaning was carried out by immersing the test pieces for 2 minutes in the cleaning agents of cleaning temperatures shown in Table 1, respectively. After the cleaning, the test pieces were drawn up, rinsed with running water for 1 minute, and dried at 80° C. for 20 minutes, and oily matter removal ratios were evaluated on the respective test pieces according to the weight method.

The above procedure was repeated 100 times, the floating oils in the cleaning agents were removed, and oily matter remaining in the cleaning agents was analyzed by the n-hexane method. The second cleaning was carried out under the same conditions as above using the resultant cleaning agents.

The resultant oily matter removal ratios are shown in Table 1.

Further, the flash points of these cleaning agents were measured according to JIS K-2265 Test Method for Measuring Flash Points of Crude Oil and Petroleum Products, and the results are shown in Table 1, too. The measuring method of JIS K-2265 can be outlined as follows.

The following procedure is carried out using a Cleveland open-cup flash point tester.

① A sample is filled into an oil cup up to the marked line (about 80 cc) .

② The test flame nozzle is ignited.

③ The sample is heated (heated at the rate of 15° C./mi n up to about 60° C., and thereafter at the rate of about 5° C./min).

④ At 60° C. or more, the test flame is horizontally passed over the oil cup for about 1 second so as to pass at the center of the oil cup, every time the reading of the thermometer rises by 2° C. At that time, it is observed by visual observation if inflammation takes place, and when inflammation takes place, its lowest temperature is recorded.

The meanings of the abbreviations in the table are as follows. The values in the parentheses are solubilities in water at 60° C.

Component (A)

DPM: Dipropylene glycol monomethyl ether

TPM: Tripropylene glycol monomethyl ether

PE: Propylene glycol monoethyl ether

PDM: Propylene glycol dimethyl ether

Component (B)

PP: Propylene glycol monopropyl ether (28% by volume)

DPP: Dipropylene glycol monopropyl ether (10% by volume)

PB: Propylene glycol monobutyl ether (6% by volume)

DPDM: Dipropylene glycol dimethyl ether (36% by volume)

TPDM: Tripropylene glycol dimethyl ether (24% by volume)

DPDE: Dipropylene glycol diethyl ether (5% by volume)

DPB: Dipropylene glycol monobutyl ether (5% by volume)

TPB: Tripropylene glycol monobutyl ether (2% by volume)

Other components

EPh: Ethylene glycol monophenyl ether (2% by volume)

TABLE 1

| No. | Composition (V/V %) | | | | | | | | | | | |
|---|---|---|---|---|---|---|---|---|---|---|---|---|
| | A | | | | | B | | | | | | |
| | DPM, | TPM, | PE, | DPE, | PDM | PP, | DPP, | DPDM, | TPDM, | DPDE, | DPPM | Water |
| Example | | | | | | | | | | | | |
| 1 | 20 | | | | | 20 | | | | | | 60 |
| 2 | 15 | | | | | | 10 | | | | | 75 |
| 3 | 20 | | | | | | 60 | | | | | 20 |
| 4 | 25 | | | | | | 10 | | | | | 65 |
| 5 | 25 | | | | | | 50 | | | | | 25 |
| 6 | 30 | | | | | | 40 | | | | | 30 |
| 7 | 20 | | | | | | | 65 | | | | 15 |
| 8 | 35 | | | | | | | | 35 | | | 30 |
| 9 | 50 | | | | | | | | | 30 | | 20 |
| 10 | 50 | | | | | | | | | | 30 | 20 |
| 11 | | 50 | | | | | 20 | | | | | 30 |
| 12 | | | 25 | | | | | 30 | | | | 45 |
| 13 | | | | | 50 | | | | 20 | | | 30 |
| 14 | | | | 50 | | | 20 | | | | | 30 |
| Comparative example | | | | | | | | | | | | |
| 1 | | | 70 | | | | | | | | | 30 |
| 2 | 70 | | | | | | | | | | | 30 |
| 3 | | | | | | 15 | | | | | | 85 |
| 4 | | | | | | | 12 | | | | | 88 |

| No. | Flash point (°C.) | Cleaning temperature (°C.) | Oil removal ratio (%) 1st time | Oil removal ratio (%) 2nd time | Oil concentration in the cleaning agent (W %) |
|---|---|---|---|---|---|
| Example | | | | | |
| 1 | not inflamed | 50 | 85 | 85 | 0.2 |
| 2 | not inflamed | 40 | 88 | 85 | 0.1 |
| 3 | not inflamed | 50 | 98 | 99 | 1.2 |
| 4 | not inflamed | 50 | 90 | 88 | 0.1 |
| 5 | not inflamed | 40 | 97 | 95 | 1.0 |
| 6 | not inflamed | 40 | 95 | 96 | 0.8 |
| 7 | not inflamed | 60 | 93 | 95 | 1.0 |
| 8 | not inflamed | 60 | 93 | 93 | 0.2 |
| 9 | not inflamed | 60 | 95 | 85 | 0.2 |
| 10 | not inflamed | 60 | 92 | 93 | 0.3 |
| 11 | not inflamed | 50 | 90 | 90 | 0.1 |
| 12 | not inflamed | 50 | 92 | 92 | 0.5 |
| 13 | not inflamed | 50 | 90 | 90 | 0.2 |
| 14 | not inflamed | 60 | 88 | 89 | 0.1 |
| Comparative example | | | | | |
| 1 | 72 | 60 | 65 | 65 | under 0.1 |
| 2 | not inflamed | 60 | 67 | 65 | under 0.1 |
| 3 | not inflamed | 60 | 54 | 50 | under 0.1 |
| 4 | not inflamed | 60 | 50 | 50 | under 0.1 |

EXAMPLES 15 and 16

Comparison between DPP and PB as the component (B) (in view of inflammability)

The process of Examples 1 to 14 was repeated on cleaning agents having the compositions shown in the following Table 2. The results are shown together in Table 2.

TABLE 2

| Example No. | Composition (V/V %) A DPM | B PB | B DDP | C Water | Flash point (°C.) | Oil removal ratio (%) |
|---|---|---|---|---|---|---|
| 3 | 20 | | 60 | 20 | not inflamed | 98 |
| 15 | 20 | 60 | | 20 | 92 | — |
| 16 | 30 | 40 | | 30 | not inflamed | 95 |

*Cleaning temperature: 50° C.

Although the flash point of PB is 62° C., it is possible, in the three components system of this invention, to greatly raise flash point, but nevertheless the composition having the low water content still has inflammability. This means that when PB having relatively high inflammability is used, there is a need to increase the amount of water, and on the other hand, in order to ensure compatibility, there is a need to increase the amount of the component (A), too. Therefore, when characteristics on inflammability equal to the system wherein DPP was used are desired, the lowering of the oil removal ratio is unavoidable.

EXAMPLES 17 TO 19

Comparison among DPP, DPB and TPB as the component (B) (in view of compatibility)

Compositions exhibiting compatibility at 50° C., shown in the following Table 3 were prepared. Since DPB and TPB have only low solubilities in water, there was a need to make the amount of the component (A) relatively large, for obtaining a single phase. The oil removal test was carried out according to the method described in the preceding examples. The results are shown together in Table 3.

TABLE 3

| Example No. | Composition (V/V %) C Water | B DPP | B DPB | B TPB | A DPM | Oil removal ratio (%) |
|---|---|---|---|---|---|---|
| 17 | 20 | 65 | | | 15 | 99 |
| 18 | 20 | | 50 | | 30 | 93 |
| 19 | 20 | | | 40 | 40 | 92 |

What is claimed is:

1. A cleaning agent for removing fats and oils adhered to metal pieces, electronic parts or semiconductor parts which comprises the following components:

(A) at least one water easily soluble propylene glycol alkyl ether represented by the formula (I)

$$R^1O\text{-}(CH(CH_3)CH_2O)_m\text{-}(CH_2CH(CH_3)O)_n\text{-}R^2 \quad (I)$$

wherein $R^1$ and $R^2$ are, independently, hydrogen atoms, methyl groups or ethyl groups, m and n are, independently, 0 or an integer of 1 to 3, and m+n is 1 to 3, provided that, one of $R^1$ and $R^2$ is a group other than a hydrogen atom, and when both $R^1$ and $R^2$ are groups other than hydrogen atoms, both these substituents are methyl groups, and m is 1 and n is 0, (B) at least one water sparingly soluble propylene glycol alkyl ether represented by the formula (II)

$$R^3O\text{-}(CH(CH_3)CH_2O)_p\text{-}(CH_2CH(CH_3)O)_q\text{-}R^4 \quad (II)$$

wherein $R^3$ and $R^4$ are, independently, hydrogen atoms, $C_{1-4}$ alkyl groups, p and q are, independently, 0 or an integer of 1 to 3, and p+q is 1 to 3, provided that one of $R^3$ and $R^4$ is a group other than a hydrogen atom, and when one of $R^3$ and $R^4$ is a hydrogen atom, the other substituent is an alkyl group of $C_3$ or more, when $R^3$ and $R^4$ are independently, methyl or ethyl groups, p+q is an integer of 2 or more, and (C) water;

said cleaning agent forming a single phase wherein the propylene glycol ether (A) is present in amounts of 25% or more by volume, the propylene glycol alkyl ether (B) is present in amounts of 20% or more by volume and, the water (C) is present in amounts of 20% or more by volume, respectively, based on the whole volume of the cleaning agent.

2. The cleaning agent of claim 1 wherein the propylene glycol alkyl ether of (A) is one or more ethers selected from the group consisting of propylene glycol monomethyl ether, dipropylene glycol monomethyl ether, tripropylene glycol monomethyl ether, propylene glycol monoethyl ether, dipropylene glycol monoethyl ether and propylene glycol dimethyl ether.

3. The cleaning agent of claim 1 wherein the propylene glycol alkyl ether of (B) is one or more ethers select ed from the group consisting of propylene glycol monopropyl ether, dipropylene glycol monopropyl ether, tripropylene glycol monopropyl ether, dipropylene glycol dimethyl ether, tripropylene glycol dimethyl ether, dipropylene glycol diethyl ether and dipropylene glycol dipropyl ether.

4. The cleaning agent of claim 1 wherein the propylene glycol alkyl ether of (A) is selected from the group consisting of dipropylene glycol monomethyl ether, propylene glycol monoethyl ether and propylene glycol dimethylether, and the propylene glycol alkyl ether of (B) is selected from the group consisting of propylene glycol monopropyl ether, dipropylene glycol monopropyl ether and dipropylene glycol dimethyl ether.

5. The cleaning agent of claim 1 wherein the propylene glycol alkyl ether of (A) is selected from the group consisting of dipropylene glycol monomethyl ether, propylene glycol monoethyl ether and propylene glycol dimethyl ether, and the propylene glycol alkyl ether of (B) is dipropylene glycol monopropyl ether.

6. A process for cleaning metal pieces, electronic parts or semiconductor parts to which fat and oil adhered, which comprises (a) a step of preparing a cleaning agent which comprises 25% by volume or more per the whole volume of the cleaning agent of (A) at least one water easily soluble propylene glycol alkyl ether represented by the formula (I)

$$R^1O(CH(CH_3)CH_2O)_m(CH_2CH(CH_3)O)_nR^2 \quad (I)$$

wherein $R^1$ and $R^2$ are, independently, hydrogen atoms, methyl groups or ethyl groups, m and n are, independently, 0 or an integer of 1 to 3, and m+n is 1 to 3, provided that one of $R^1$ and $R^2$ is a group other than a hydrogen atom, and when both $R^1$ and $R^2$ are groups other than hydrogen atoms, both these substituents are methyl groups, and m is 1 and n is 0, 20% by volume or more per the whole volume of the cleaning agent of (B) at least one water sparingly soluble propylene glycol alkyl ether represented by the formula (TT)

$$R^3O(CH(CH_3)CH_2O)_p(CH_2CH(CH_3)O)_qR^4 \quad (II)$$

wherein $R^3$ and $R^4$ are, independently, hydrogen atoms, $C_{1-4}$ alkyl groups, p and q are, independently, 0 or an integer of 1 to 3, and p+q is 1 to 3, provided that one of $R^3$ and $R^4$ is a group other than a hydrogen atom, and when one of $R^3$ and $R^4$ is a hydrogen atom, the other substituent is an alkyl group of $C_3$or more, when $R^3$ and $R^4$ are, independently, methyl or ethyl groups, p+q is an integer of 2 or more, and one of $R^3$ and $R^4$ is a group other than a hydrogen atom, and 15% by volume or more per the whole volume of the cleaning agent of (C) water, and forms a single phase wherein each component is dissolved in the other components, and (b) a step of immersing the above matter to be cleaned on which fat and oil adhered in the cleaning agent, or showering or spraying the cleaning agent on the matter to be cleaned.

7. The cleaning process of claim 6 wherein the propylene glycol alkyl ether of (A) in the cleaning agent is selected from the group consisting of propylene glycol monomethyl ether, dipropylene glycol monomethyl ether, tripropylene glycol monomethyl ether, propylene glycol monoethyl ether, dipropylene glycol monoethyl ether and propylene glycol dimethyl ether, and the propylene glycol alkyl ether of (B) is selected from the group consisting of propylene glycol monopropyl ether, propylene glycol monobutyl ether, dipropylene glycol monopropyl ether, tripropylene glycol monopropyl ether, dipropylene glycol dimethyl ether, tripropylene glycol dimethyl ether, dipropylene glycol diethyl ether and dipropylene glycol dipropyl ether.

* * * * *